US006453791B1

(12) United States Patent
Seitzinger

(10) Patent No.: US 6,453,791 B1
(45) Date of Patent: Sep. 24, 2002

(54) CONCEALABLE BODY ARMOR BRIEFS

(76) Inventor: Kyle Seitzinger, 14558 Oak Chase, Houston, TX (US) 77062

( * ) Notice: Subject to any disclaimer, the term of this patent is extended or adjusted under 35 U.S.C. 154(b) by 0 days.

(21) Appl. No.: 09/578,870

(22) Filed: May 25, 2000

(51) Int. Cl.[7] ..... F41H 5/08; F41H 1/02
(52) U.S. Cl. ..... 89/36.05; 2/2.5
(58) Field of Search ..... 89/36.05; 2/2.5

(56) References Cited

U.S. PATENT DOCUMENTS

| | | | | | |
|---|---|---|---|---|---|
| 2,790,973 | A | * | 5/1957 | Lewis, Jr. et al. | 2/2.5 |
| 3,331,083 | A | * | 7/1967 | Holly | 2/2.5 |
| 3,771,171 | A | * | 11/1973 | Mitchell | 2/2.5 |
| 3,829,899 | A | * | 8/1974 | Davis | 2/2.5 |
| 4,316,286 | A | * | 2/1982 | Klein | 2/2.5 |
| 4,475,247 | A | * | 10/1984 | Lee | 2/2.5 |
| 5,044,011 | A | * | 9/1991 | Henderson | 2/2.5 |
| 5,327,811 | A | * | 7/1994 | Price et al. | 89/36.05 |
| 5,373,582 | A | | 12/1994 | Dragone | 2/2.5 |
| 5,443,882 | A | | 8/1995 | Park | 428/103 |
| 5,443,883 | A | | 8/1995 | Park | 428/103 |
| 5,471,906 | A | * | 12/1995 | Bachner, Jr. et al. | 89/36.05 |
| 5,572,737 | A | * | 11/1996 | Valice | 2/465 |
| 5,829,653 | A | | 11/1998 | Kaiser | 224/577 |
| 5,926,856 | A | * | 7/1999 | Duval | 2/455 |
| 5,970,513 | A | | 10/1999 | Kocher | 2/2.5 |
| 5,974,585 | A | * | 11/1999 | Bachner, Jr. | 2/2.5 |
| 5,996,115 | A | | 12/1999 | Mazelsky | 2/2.5 |
| 6,026,510 | A | | 2/2000 | Kocher | 2/2.5 |

* cited by examiner

*Primary Examiner*—Charles T. Jordan
*Assistant Examiner*—John W. Zerr
(74) *Attorney, Agent, or Firm*—Wendy Buskop

(57) ABSTRACT

An undergarment body armor comprising elastic pants, at least one removable ballistic protection pad configured to cover at least the femoral artery path of a wearer; and elastic shorts adapted to hold the ballistic protection pads in closable pockets created into the elastic pants.

12 Claims, 6 Drawing Sheets

CONCEALABLE BODY ARMOR BRIEFS

BACKGROUND OF INVENTION

Gun shot wounds to the femur artery of the human body cause death in most cases. Body armor has existed for many years, but undergarment body armor for the lower portion of the body, particularly to cover the artery of the femur has not traditionally existed.

The concept was developed to provide protection to the thighs, lower abdomen and hamstring area of the leg. The undergarment can be made of a sturdy, breathable material, similar to athletic undergarments.

The major types of conventional body armor are Over-clothing Body Armor or externally worn body armor, as typically seen in the movies for swat team shots, hereinafter referred to as OBA, and concealable body armor normally worn under a shirt, hereinafter referred to as UBA Over-clothing body armor is generally bulky, heavy, and sometimes very conspicuous when worn. The military and law enforcement versions of OBA include flack jackets or body armor. For civilian clothing use, versions of OBA have been made to look like cold weather coats or jackets to provide less conspicuous protection when required. However, cold weather coats worn during warm weather are not inconspicuous. The business suit jacket is a more versatile, less conspicuous configuration of OBA, but this configuration lacks frontal below the belt protection, which is considered by many to be a most vital area.

Existing concealable body armor typically weighs 4 to 10 pounds, creates body -heat build up, and restricts the movement of the user due to the UBA material's inflexibility. Another major disadvantage of UBA is its difficulty to put on and take off since it is worn under other clothing. Additionally, there is only one form of UBA which is available for use "below the belt and it is a cumbersome apron like device which is difficult to move in and adjust.

The numerous disadvantages of conventional UBA result in the reluctance of an individual to wear the equipment unless the user feels substantially threatened. This results in the user taking risks of not wearing body armor when it is warranted.

Vascular injuries to the lower abdomen and lower extremities carry a high mortality rate. In a study at Ben Taub Hospital, of Houston, Tex., of 600 patients with penetrating trauma to the iliac vessels and femoral arteries, 39% died within 30 days of injury. In certain cases of penetrating trauma to the iliac vessels, cardiac arrest occurred within 6 to 8 minutes of impact.

The present invention relates to an under body garment which provides protection over the femur artery, the femoral artery path and yet is light, and breathable so that a user will actually wear it during duty.

There are many patents in the body armor area, see for example, U.S. Pat. No. 5,327,811, 5,373,582, 5,443,882, 5,443,883, 5,471,906, 6,026,510, 5,996,115 5, 970,513, 5,829,653, all incorporated by reference.

BRIEF SUMMARY OF THE INVENTION

The invention relates to undergarment body armor which comprises one or two or more ballistic protection pads which have from 13 to 22 layers of ballistic material although 13 to 18 layers is the most preferred, and wherein the pads are shaped to cover a wearer's femoral artery path, and other vital areas of the lower torso, particularly the pelvic area. In a preferred embodiment, the invention is directed to elastic shorts adapted to hold the multilayer ballistic protection pads in closable pockets created into the elastic shorts.

DETAILED DESCRIPTION

Figure 1:
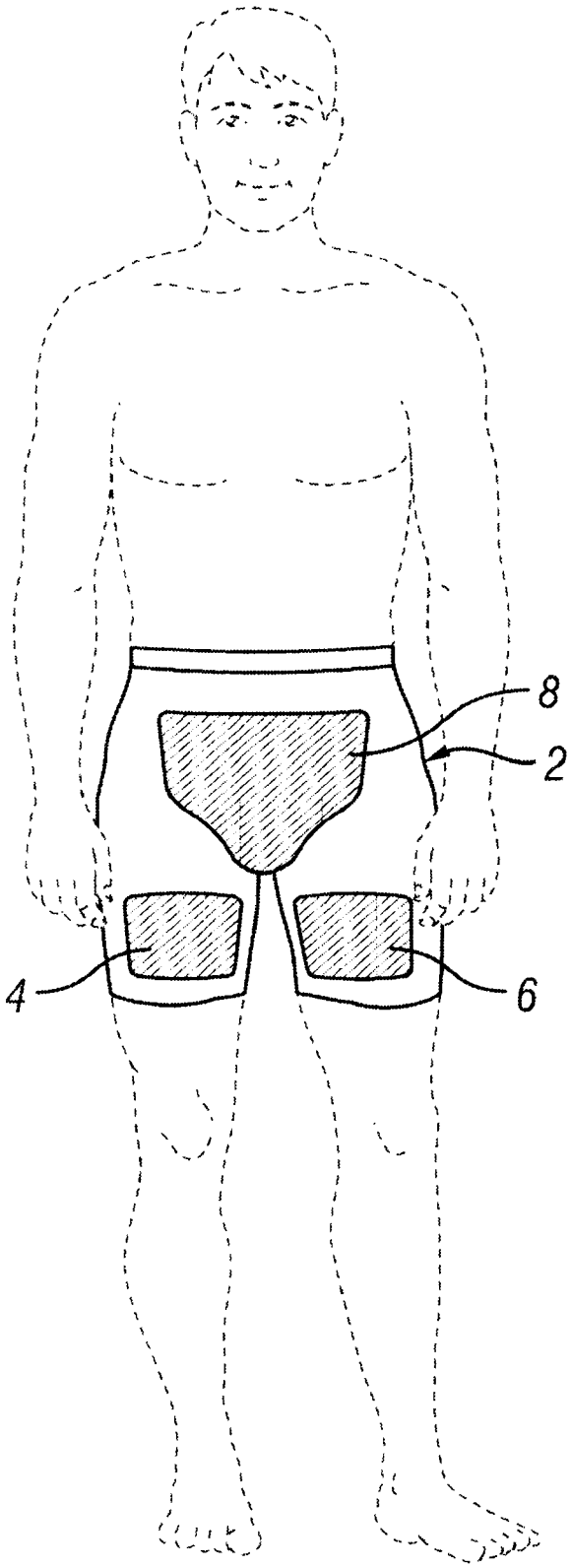
FIG. 1 shows a cut away front view of a pair of shorts with the packets inserted.
Figure 2:
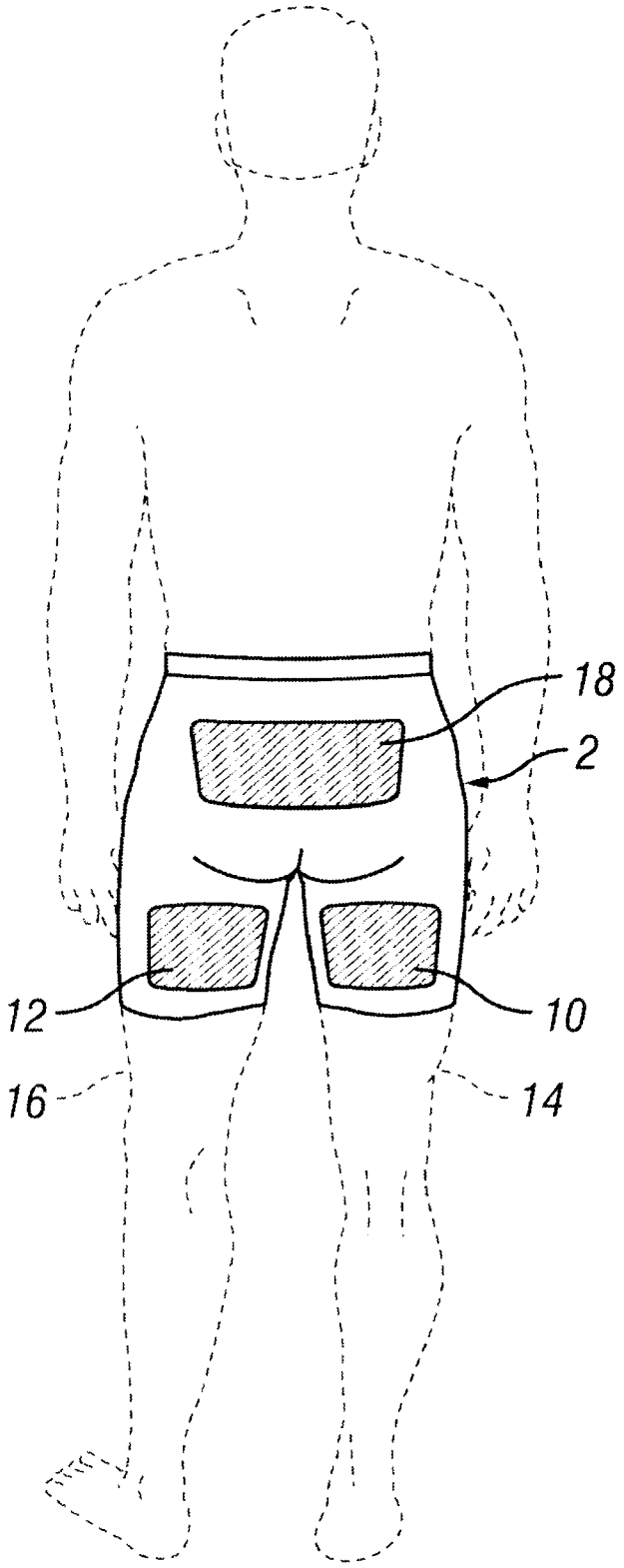
FIG. 2 is a cut away back view of a pair of shorts with the packets inserted.
Figure 3:
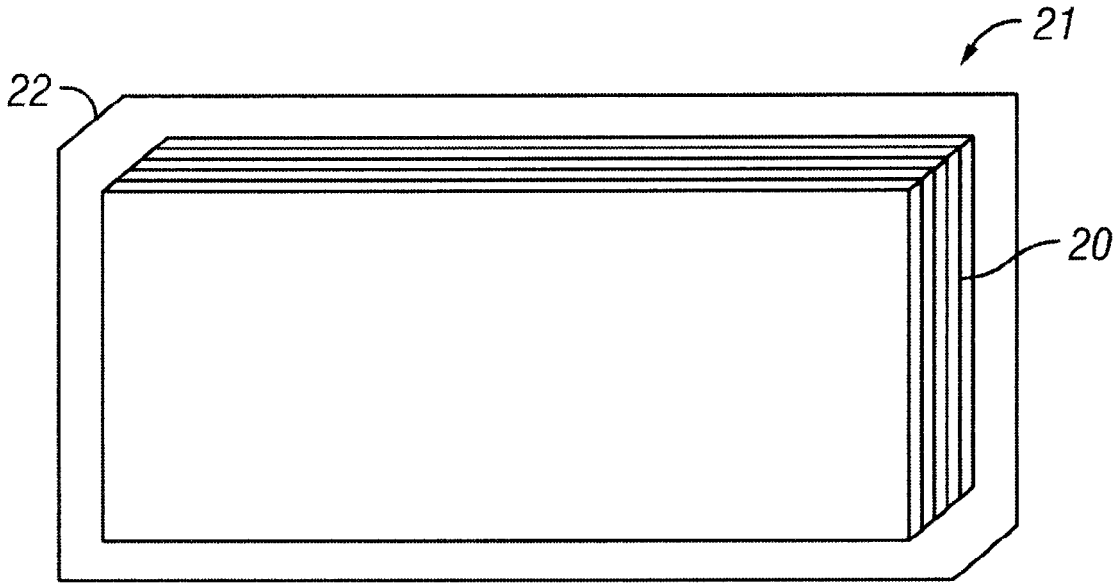
FIG. 3 is a detail perspective view of a ballistic packet of a preferred embodiment.

The present invention is directed at an undergarment (2), such as boxer shorts, form fitted lightweight shorts, panties or briefs, which comprise strategically placed body armor packets (4) (6) and (8), which particularly cover the pelvic area, including the genital area of the body and/or the femur arteries of the human body. In the most preferred embodiment, the undergarment body armor comprises shorts made of an elastic material, such as spandex, or a blend of spandex and cotton, which is lightweight. In one embodiment, it is preferred that the undergarment weighs less than 2 pounds and covers the human pelvis area and femurs, the femoral artery path. Sewn into the undergarment, and opening against the body at strategic points, are pockets, which can be closable. Into those pockets, which can be closed by any known method, such as snaps, although use of VELCRO strips would be the most preferred embodiment, can be inserted multilayer packets of ballistic material, referred to herein as body armor. Ballistic material usable in these ballistic protection packets can be available from any one of a variety of manufacturers, such as "SPECTRAFLEX" available from Allied Signal Company. FIG. 2 shows a cut away back view of the undergarment (2) with the body armor packets (10) and (12) covering the femoral artery paths of each leg (14) and (16). In one embodiment, an additional packet (18) can be added to the undergarment (2) to provide protection from debilitating gunshot wounds to the spine which could paralyze an officer with one bullet. These multi-layer packets can be of a variety of shapes. FIG. 3 shows a ballistic packet (21) of rectangular shape which is considered the most usable to extend over the tops of the legs, with the longest part of the packet being perpendicular to the femur. However, other shapes could be used as well. Squares, circles, and dog bone shapes of ballistic protection packets could all be used to femoral artery path protection Various shapes can be used for the packets, which are inserted over the pelvis area of the body These could be of the same shape as the femur area or a different shape. The key is selecting a shape that has comfort yet affords coverage.

Figure 4:
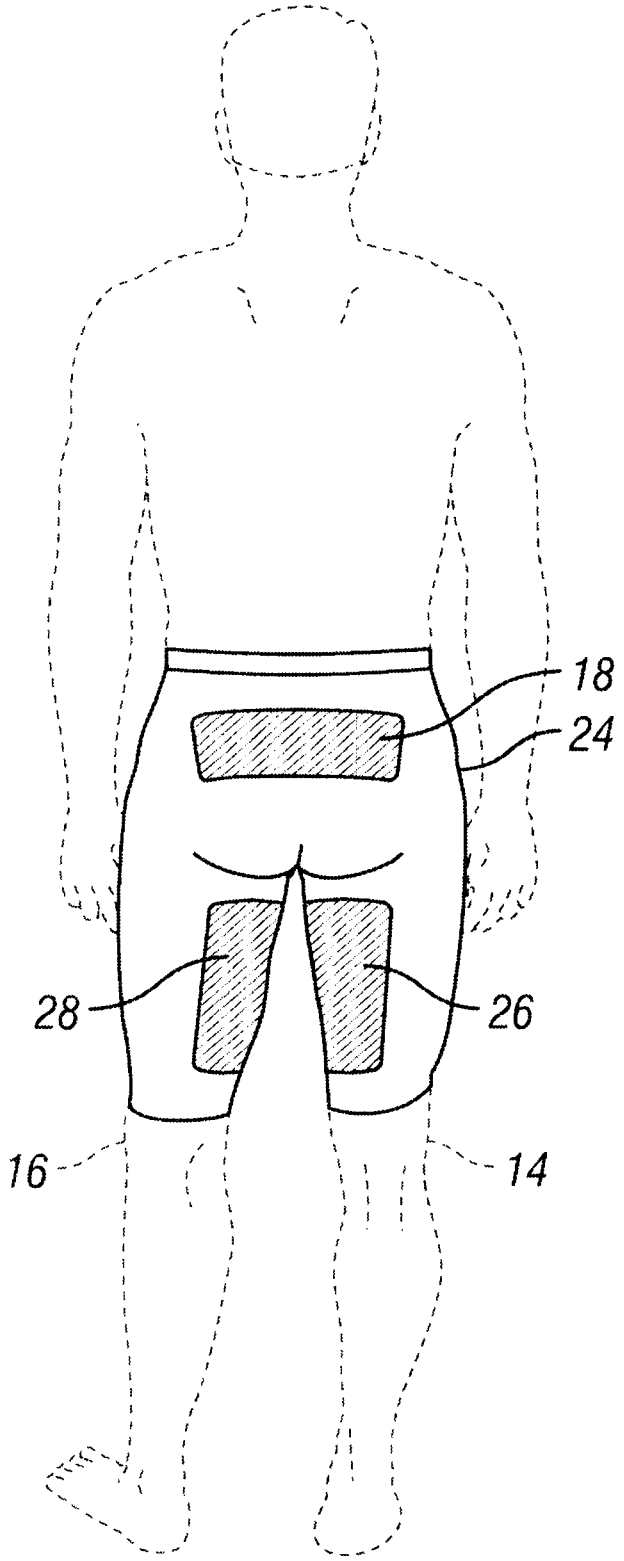
FIG. 4 shows extended length pants as an alternative embodiment of the present invention.

In alternative embodiment shown in FIG. 4, are extended length pants (24). In this embodiment the body armor is shown with two ballistic protection packets (26) and (28) which wrap around a portion of legs (16) and (14) The optional back ballistic protector packet (18) is shown as well. FIG. 3 shows a multilayer ballistic protection packet of ballistic material (20) which is enclosed by a ballistic nylon, water resistant, tear resistant, covering (22) which is sewn or glued at the edges. The covering may be secured with any conventional closing material to provide protection to the lower abdominal area. The briefs will contain a "strap' of body armor, which will be placed laterally in the lower abdominal area to provide protection to these area.

Figure 5:
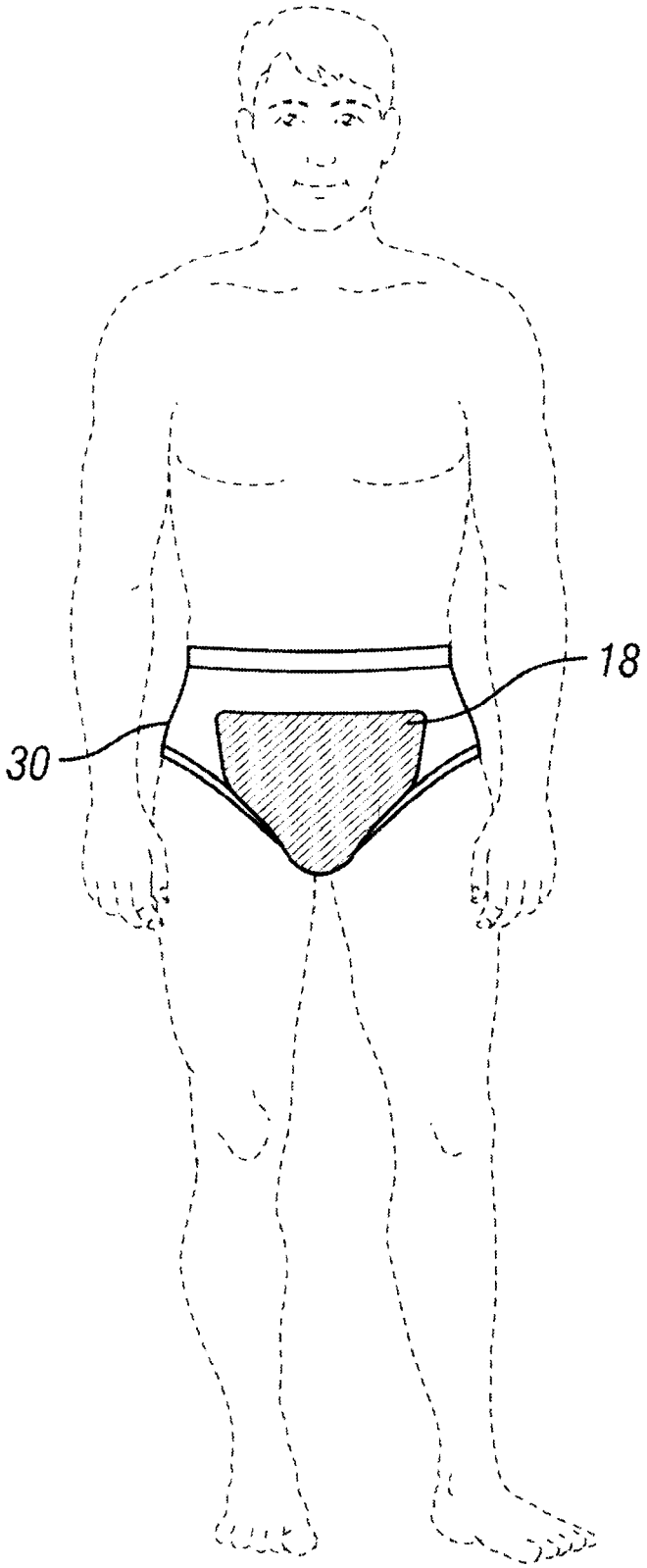
FIG. 5 shows a version of the present invention as low rise briefs.

The shorts will provide protection to the majority of the thigh muscle, and wrap around to the inner thigh areas, where the femoral artery path is exposed. The back of the leg will have body armor over the hamstring area. Briefs can also be an embodiment of the present invention as shown in FIG. 5. Briefs (30) can contain at least one ballistic protection packet (32).

The Type IIa armor that is contained in the briefs is very flexible and placed in pockets sewn into the briefs. This allows the body armor to be removed easily for general care for the briefs.

In a preferred embodiment, the pockets into which the packets are placed are sewn in such a manner as to exactly conform to the shape of the packet. These enables secure attaching of the packets to the undergarment, so that during a tactical maneuver, the ballistic protection does not come off or move away from the critical area.

Figure 6:
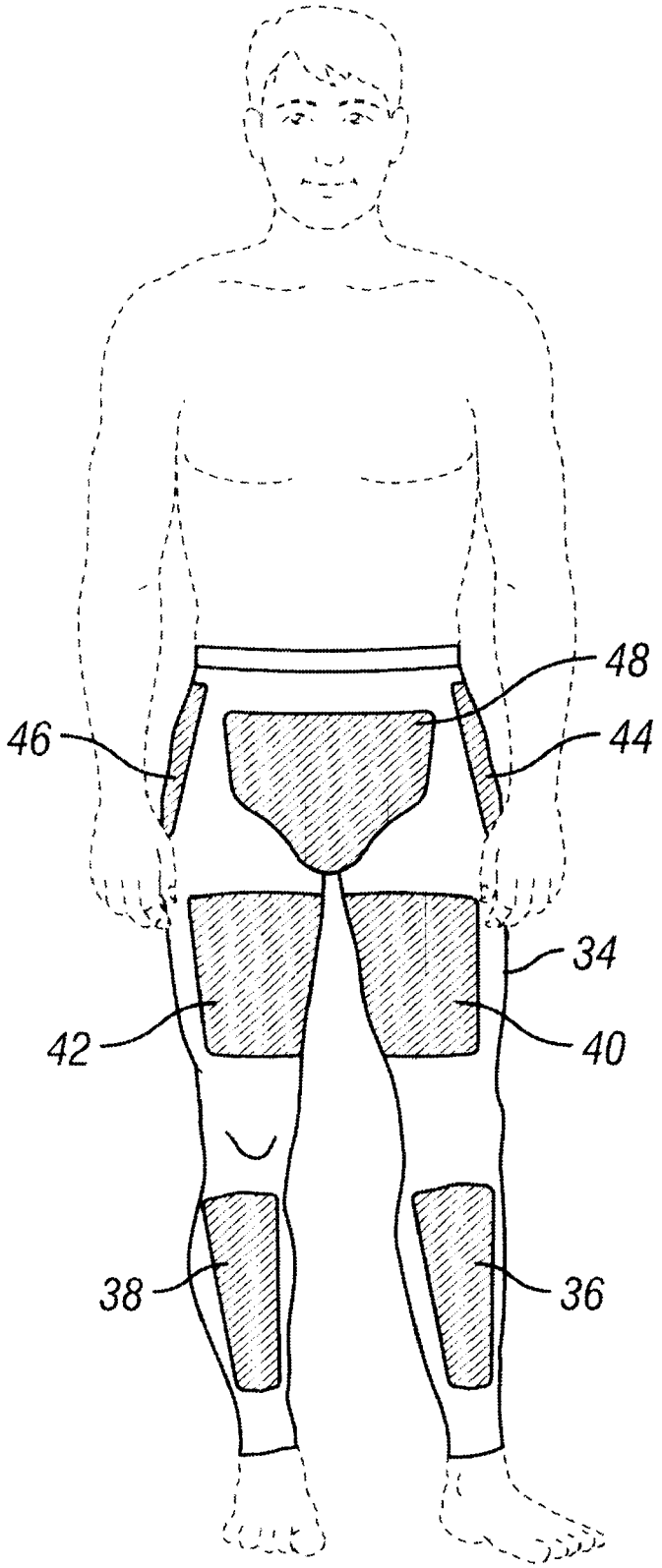
FIG. 6 shows a full-length version of the subject matter of the invention.

It is also considered that the pockets are sewn so that the openings face the body, and touch the skin side of More specifically, as best shown in FIG. 6, pants (34) have multilayer ballistic material packets inserted into pockets at positions over the calf (36) and (38), over the hamstring (40) and (42), on the sides of the thigh (44) and (46) and optionally over the lower back (48).

The multilayer ballistic material packet (21) is comprised of at least 13, but up to 22 or more layers of ballistic material, which impedes bullet penetration. Even up to 30 layers is considered usable to protect the femoral artery path. However, cotton could be used as well as the covering. The fabric should be selected to be washable and resist damage if pulled upon.

It is expected that the invention is comfortable and can be worn all day with minimum discomfort. The invention can be put on when the user is in an exposed environment and taken off when the user returns to a safe environment such as his office.

The national Institute of Justice (NU) grades the levels of body armor, and it is considered that NIJ grade levels II and IIIa are usable in the invention Grade II uses 15 layers of ballistic material and is capable of stopping a bullet fired by a 357 Magnum at a velocity of 1,395 feet per second. The same grade level stops a 9 mm bullet fired at a velocity of 1,175 feet per second. The present invention can be used with a Grade IIa ballistic protection, having 13 layers, and can ability to stop a 9 mm bullet travelling at a velocity of 1,090 feet per second. It is contemplated to be within the scope of the invention to use IIIa and II levels of ballistic protection which are 18 layers and 18 layers with a thin metal plate, such as made from titanium. Level III protection stops a 7.63 NATO round of bullets travelling at a velocity of 2,750 feet per second.

The body armor system can consist of a ballistic fabric with or without a trauma plate or a pocket and hard plate configuration for greater threats. Varying levels of protection can be designed whereby the under garment component may have a higher or lower level of protection than that of the outer garment component.

The body armor system can be worm similar to conventional briefs, boxer shorts and long johns. This body armor system better accommodates hot environments and enables the soldier or police officer to experience coolness and heat dissipation since the protection is used in segments rather than totally over the body as with known systems. When worn by a user, the invention can reduce the ballistic threat exposure of open briefs and boxer shorts and still allow good ventilation like briefs and boxer shorts.

The invention can simply be worn under any conventional pants, or even a skirt. The invention is designed to cover the femoral artery path in the most preferred embodiment to protect the user from a highly probable fatal shot.

It is within the scope of the present invention to include custom sized protective undergarments and child size protective briefs such as for celebrities or rock star's children. A one-piece protection packet inserted into shorts and extending from edge to edge of the garment is also contemplated to be within the scope of this invention.

Tests were performed on the unique elastic undergarment. The undergarment was placed on a hanger in a range at 7 yards from the shooter.

FIRST TEST

A Smith and Wesson 38-caliber gun was used with a 38-caliber hollow point bullet. The bullet was fired at the invention using a 17-layer ballistic protection pad and the bullet bounced off of the invention.

SECOND TEST

Smith and Wesson 40 caliber Semi-Automatic gun was used with a Smith and Wesson 40 caliber hollow point. The bullet was fired at 7 yards from the test object and with 17 layers of ballistic material in the ballistic protection packets, it bounced off.

THIRD TEST

The invention was taped to a bucket full of lead. At 7 yards a Smith and Wesson 686 gun with a 4" barrel was fired using a 357-magnum black talon hollow point bullet. The bullet embedded in the ballistic protection material without penetrating through the material.

FOURTH TEST

The invention was tested with a Colt 1911 gun that fired a 45-caliber black talon hollow point bullet at 7 yards. The bullet embedded in the fabric without penetrating through the fabric.

The foregoing is considered as illustrative only of the principles of the invention. Furthers since numerous modifications and changes will readily occur to those skilled in the art, it is not desired to limit the invention to the exact construction and operation shown and described, and accordingly, all suitable modifications and equivalent may be resorted to, falling within the scope of the invention.

What is claimed is:

1. An undergarment body armor capable of femoral artery protection comprising;

undergarment elastic pants;

at least two closable pockets sewn into said elastic pants covering each femoral artery path around the inside of each leg;

at least two removable ballistic protection pads configured to cover said each femoral artery path of a wearer.

2. The undergarment body armor of claim 1, wherein the ballistic protection pads comprise from 13 to 22 layers of ballistic material.

3. The undergarment body armor of claim 1, wherein said closable pockets are secured with hook and loop fasteners.

4. The undergarment body armor of claim 1 wherein an additional ballistic protection pad is situated in said pants to cover the genital area of the body.

5. The undergarment body armor of claim 1 wherein a hard plate is supported within at least one of said closable pockets in addition to said ballistic protection pads.

6. A body armor system comprising:

a stretchable undergarment for wearing under pants of a user; and at least two ballistic resistance packets covering each femoral artery path of a wearer around the inside of each leg.

7. The body armor system of claim 8 wherein the ballistic resistance packets have a thickness of from 13 to 18 layers of ballistic material.

8. The body armor system of claim 6, wherein said ballistic resistance packets are sewn from at least 18 layers of ballistic material and have a shape which generally reflects the shape of the lower half of a human.

9. The body armor system of claim 6 further comprising a hard plate located over said each femoral artery path.

10. An undergarment body armor system comprising:

stretchable undergarment bike shorts having at least two closable pockets covering the upper portions of the femurs of a user opening on the body side of a wearer covering each femoral artery around the inside of each legs and a plurality of removable ballistic resistance packets covering the upper portions of the femurs of a user and the genitalia area of a user disposed in non-removable closable pockets on said bike shorts.

11. The body armor of claim 10, wherein said ballistic resistance packets have a thickness of from 13 to 22 layers of ballistic material.

12. The body armor of claim 10, wherein said ballistic resistance packets are rectangular in shape having 18 layers of ballistic material.

* * * * *